United States Patent [19]

Sogo et al.

[11] Patent Number: 4,679,927

[45] Date of Patent: Jul. 14, 1987

[54] IMAGE FORMING APPARATUS

[75] Inventors: Toshiyuki Sogo, Ebina; Fumito Ide, Zama, both of Japan

[73] Assignee: Kabushiki Kaisha Toshiba, Kawasaki, Japan

[21] Appl. No.: 775,040

[22] Filed: Sep. 11, 1985

[30] Foreign Application Priority Data

Sep. 29, 1984 [JP] Japan ..... 59-204441
Sep. 29, 1984 [JP] Japan ..... 59-204484
Sep. 29, 1984 [JP] Japan ..... 59-204486

[51] Int. Cl.[4] ..... G03G 15/00

[52] U.S. Cl. ..... 355/3 R; 355/7; 355/14 R; 355/14 E

[58] Field of Search ..... 355/3 R, 14 R, 7, 3 E R, 355/14 E, 67, 70

[56] References Cited

U.S. PATENT DOCUMENTS 3,936,172 2/1976 McVeigh ..... 355/7 X
4,215,929 8/1980 Sato et al. ..... 355/7
4,582,417 4/1986 Yagasaki et al. ..... 355/14 R X

FOREIGN PATENT DOCUMENTS 5983453 5/1984 Japan ..... 355/7

*Primary Examiner*—A. C. Prescott
*Attorney, Agent, or Firm*—Oblon, Fisher, Spivak, McClelland & Maier

[57] ABSTRACT

An image forming apparatus for a photocopy machine. A document table holds the document to be copied. An image area designating panel on the document table designates the area of the document to be copied and generates electrical signals corresponding to the copy area when the panel is pressed. A memory stores the electrical signals generated by the panel and a plurality of light-emitting elements prevents the formation of the electrostatic latent image on the photosensitive body except for the indicated copy area, according to the electrical signals which are read from the memory.

8 Claims, 31 Drawing Figures

IMAGE FORMING APPARATUS

BACKGROUND OF THE INVENTION

This invention relates to an electrophotographic apparatus. In particular, it relates to an image forming apparatus which can form an image by designating that part of the document of which a copy is to be produced, or by omitting, on the copy, that part not required.

A demand has arisen recently for the development of an image forming apparatus with a facility for editing the document image original which it copies. In particullar, there is a strong demand or the development of a facility for omitting on the copy the unwanted part of a document image original.

One image forming apparatus has already developed which fulfils this requirement (U.S. Pat. No. 4,215,929, Sato et al.). This existing image forming apparatus consists of a light source which applies an image area control light which controls the formation of the electrostatic latent image on a photosensitive body by cutting off or applying light in association with the exposure of the document image original, a mask member which controls the said control light to a desired width by superposition, and a control means for controlling the working of this mask member. The aim here is to control the formation of the electrostatic latent image by the difference between the two operations, whereby the control light mentioned above is either transmitted or masked, and thus to obtain an image of the required area of the document image original. Depending on the way in which the mask member is superposed, either an image of a part of the document image original can be obtained, or the part can be erased and an image obtained of the remainder.

Further, this existing image forming apparatus is provided with a monitoring means which displays the document image original, and a position determining means, which in association with this monitoring means selects as desired that area of the document image original which is required. By controlling the mask member in association with the position determining means, the required area of the document image original can be selected at will as the document image original is displayed, and an image of that area obtained.

However, the existing image forming apparatus as disclosed in U.S. Pat. No. 4,215,929 has the following drawbacks.

(1) Mechanical parts, such as a motor and gears, are required to shift the mask member between the single and the superposed state, and this makes the apparatus complicated. Also, there is a strong possibility that in use over a long period the mask member will become deformed, making accurate masking impossible.

(2) The monitoring means consists of a lamp for irradiating the document, a mirror and lens for directing the light reflected from the document, and a screen on which the image of the document is projected. This monitoring means is provided separate from the document table which is provided, above the photosensitive body, for the exposure of the document. Space is therefore required for the provision of this monitoring means, and this increases the overall size of the image forming apparatus.

SUMMARY OF THE INVENTION

It is an object of the invention to provide an image forming apparatus in which, by using static parts, accurate masking can be achieved over a long period.

It is a further object of the invention to provide, by the provision, on the document table on which the document is placed, of a position determining means whereby the required area of the document image original is selected as desired, an image forming apparatus of which the overall size does not thereby have to be made larger.

The image forming apparatus of this invention comprises a document table which holds a document, an image area designating panel provided to the document table to designates a required copy area of the document, the designating panel generates electrical signals corresponding to the required copy area designated by pressing the panel, a memory memorizes the electrical signal generated by the panel and a plurality of light-emitting elements prevents the formation of the electrostatic latent image on the photosensitive body other than of the area to be copied, according to the electrical signals read from the memory.

DETAILED DESCRIPTION OF THE PREFERRED EMBODIMENT

An explanation follows of an embodiment of the invention referring to the accompanying drawings.

Figure 15:
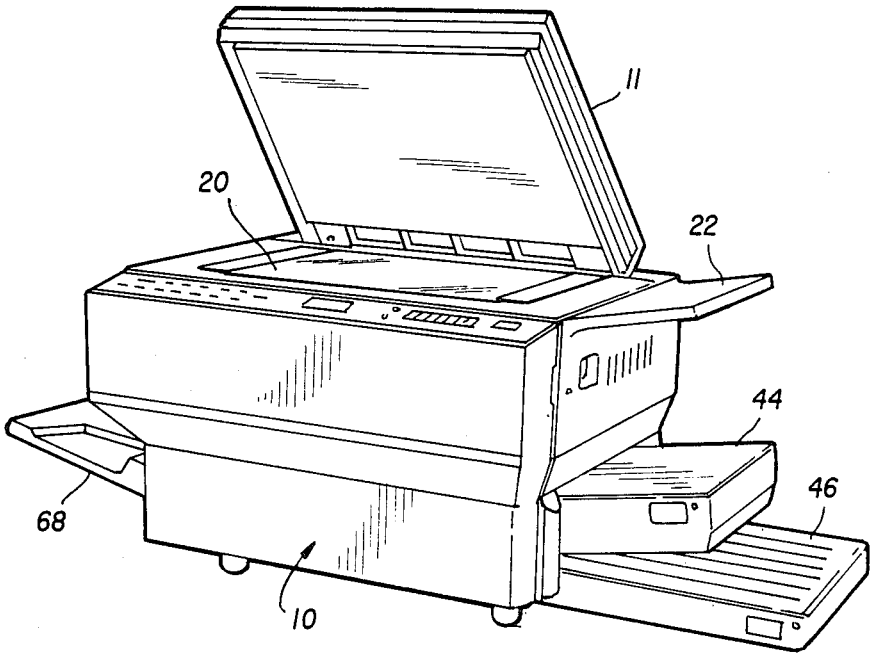
FIG. 15 is a perspective view of the image forming appartus according to this invention.
Figure 16:
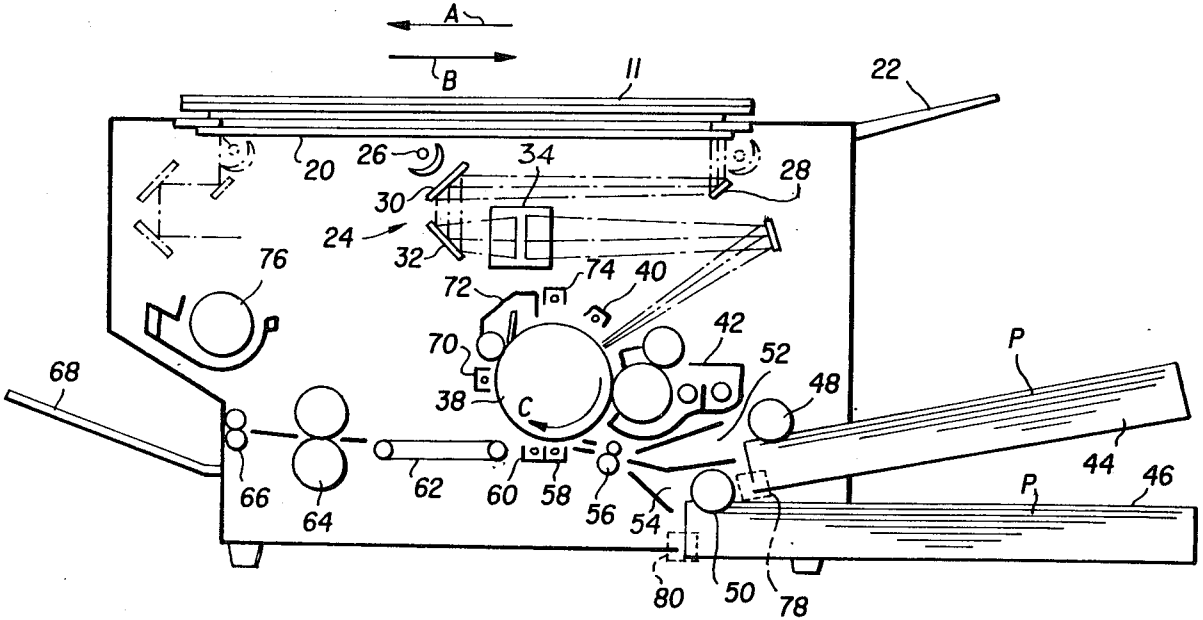
FIG. 16 is a schematic side view of the internal layout of the image forming apparatus of FIG. 15.

FIGS. 15 and 16 show an image forming apparatus, for example, an electrostatic copier. A document table 20 consisting of transparent glass which supports the document to be copied, is provided at the top of a main body 10 of the copier. This document table 20 is provided with a cover 11 which can be opened and closed, and which covers document placed on document table 20. A work table 22 is provided to the right of document table 20, projecting from main body 10. An optical system 24 such that it can move in the directions indicated by the arrows A and B, is provided below document table 20. Optical system 24 consists of an exposure lamp 26 which irradiates the document placed on document table 20, and mirrors 28, 30 and 32 which direct the light reflected from the document. When optical system 24 moves from left to right in FIG. 16, it scans the document by exposing it to light. Mirrors 30 and 32 move at half the speed of mirror 28 so as to maintain an optical path of constant length. The light reflected from the document as it is scanned by optical system 24, i.e., the light from the exposure lamp 26 reflected back from the document, after being reflected by mirrors 28, 30 and 32, passes through a lens block 34 for varying the enlargement rate of the copy. After being reflected by a mirror 36, the reflected light is directed to a photosensitive drum 38. An image of the document is then formed on the surface of photosensitive drum 38.

Photosensitive drum 38 rotates in the direction of an arrow C. First, the surface of drum 38 is electrically charged by a main charger 40. Next, an electrostatic latent image of the document is formed on drum 38 by slit exposure. This electrostatic latent image is rendered visible when the toner image is formed by the deposition of toner effected by a developing unit 42. Paper P is extracted one sheet at a time by a feed roller 48 or 50 from an upper cassette 44 or lower cassette 46, whichever has been selected. The extracted paper P is guided via a paper guide path 52 or 54 to a pair of aligning rollers 56 and is fed by this pair of rollers 56 to the image transfer station. Cassettes 44 and 46 are so arranged that they can be readly inserted or withdrawn from main body 10. One of cassettes 44 and 46 is selected by means of an operation panel (to be described later). The cassette size is detected by cassette size sensors 78 and 80 provided low down on the right of main body 10. These sensors 78 and 80 are made up of a plurality of microswitches which switch on/off according to the different size of the cassettes inserted.

Paper P which has been fed to the image transfer station, adheres closely to the surface of photosensitive drum 38 and by this means the toner image on photosensitive drum 38 is transferred by the action of a transfer charger 58 to paper P. Paper P on to which the toner image has been transferred is separated from drum 38 by the action of a separation charger 60 and carried on a conveyer belt 62. It is then fed to a pair of fixing rollers 64 provided at the end of conveyer belt 62 by means of the passage through these rollers of paper P, the toner image on paper P is fixed. After fixing, paper P is discharged by a pair of exit rollers 66 on to a receiving tray 68 provided outside main body 10. After the transfer of the toner image, the residual electric charge is removed from photosensitive drum 38 by a charge remover 70 and any residual toner is removed by a cleaner 72. Any image remaining on the drum is erased by a discharge lamp 74 and the drum is then returned to its initial state. 76 is a cooling fan to prevent the temperature inside of main body 10 from rising.

Figure 17:
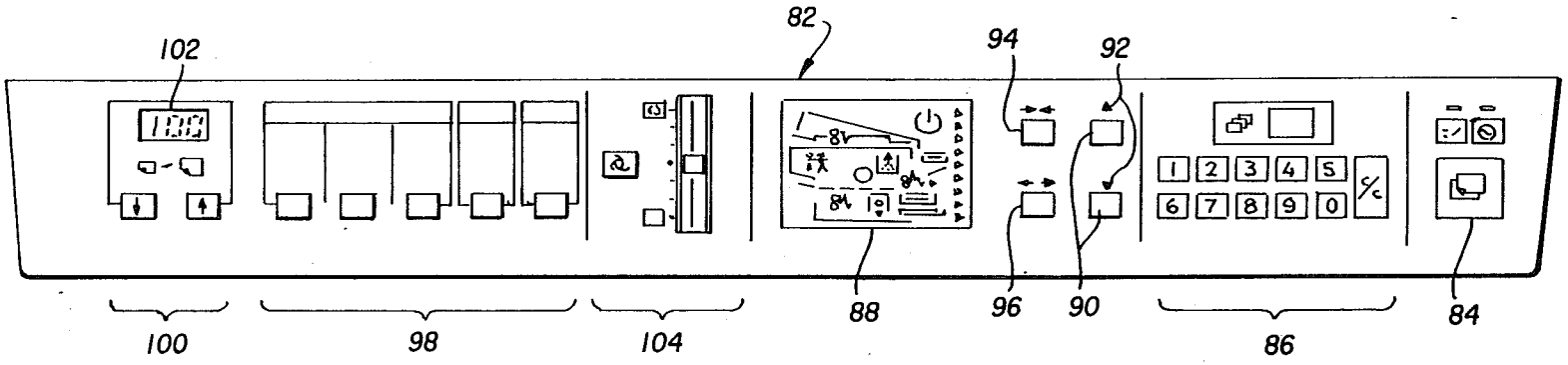
FIG. 17 is a top plan view showing the layout of the operation panel of the image forming apparatus.

FIG. 17 shows a operation panel 82 provided at the top of main body 10. On this panel are disposed a COPY button 84 for initiating the copy operation, a ten key unit 86 for setting the number of copies, a display 88 indicating the operating state, paper jam, etc.; a cassette selecting key 90 for selecting either upper cassette 44 or lower cassette 46, an indicator 92 indicating which cassette has been selected, an 'erase inside selected area' button 94 which order erasure of the part within the area designatd by the use of an image area designating panel (to be described later), an 'erase outside selected area' button 96 which orders erasure of the part outside that area, an enlaragement rate setting key 98 which sets the rate of enlargement or reduction in prescribed steps, a ZOOM key 100 which sets the rate or enlargement or reduction without the constraint of the prescribed steps, a rate display unit 102 which displays the rate that has been set and a density setter 104 which sets the density of the copy.

Figure 18:
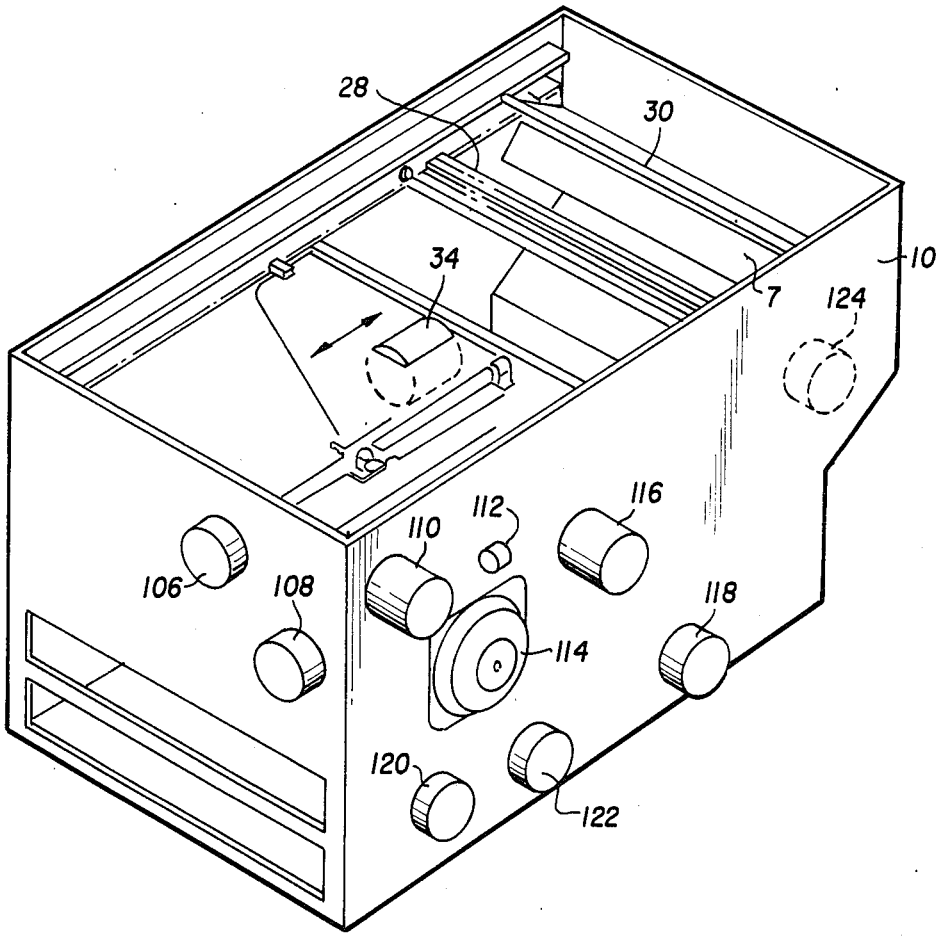
FIG. 18 is a perspective view showing the arrangement of the various drive motors used for the image forming apparatus.

FIG. 18 is a perspective view showing the arrangement of the drive sources (pulse motors) for each part of this embodiment. Unlike FIG. 15, this view is from the back of the apparatus. An enlargement/reduction rate-changing motor 106 varies the position of lens block 34. A motor 108 is for varying the distance between mirror 28 and mirror 30 (optical path length) when the enlargement/reduction rate is altered. A scanning motor 110 is for moving exposure lamp 26 and mirrors 28, 30 and 32, so that the document can be scanned. A shutter motor 112 is for moving the shutter (not shown in the drawings) for adjusting the width of the charge applied by main charger 40 to photosenstive drum 38 when the enlargement/reduction rate is alterd. A developer motor 114 is for driving the developing rollers etc. of developing unit 42. A drum motor 116 is for driving photosensitive drum 38. A fixing motor 118 is for driving pair of fixing rollers 64 and pair of exit rollers 66. A paper feed motor 120 is for driving feed rollers 48 and 50. A paper transport motor 122 is for driving pair of aligning rollers 56. A fan motor 124 is for driving cooling fan 76.

Figure 19:
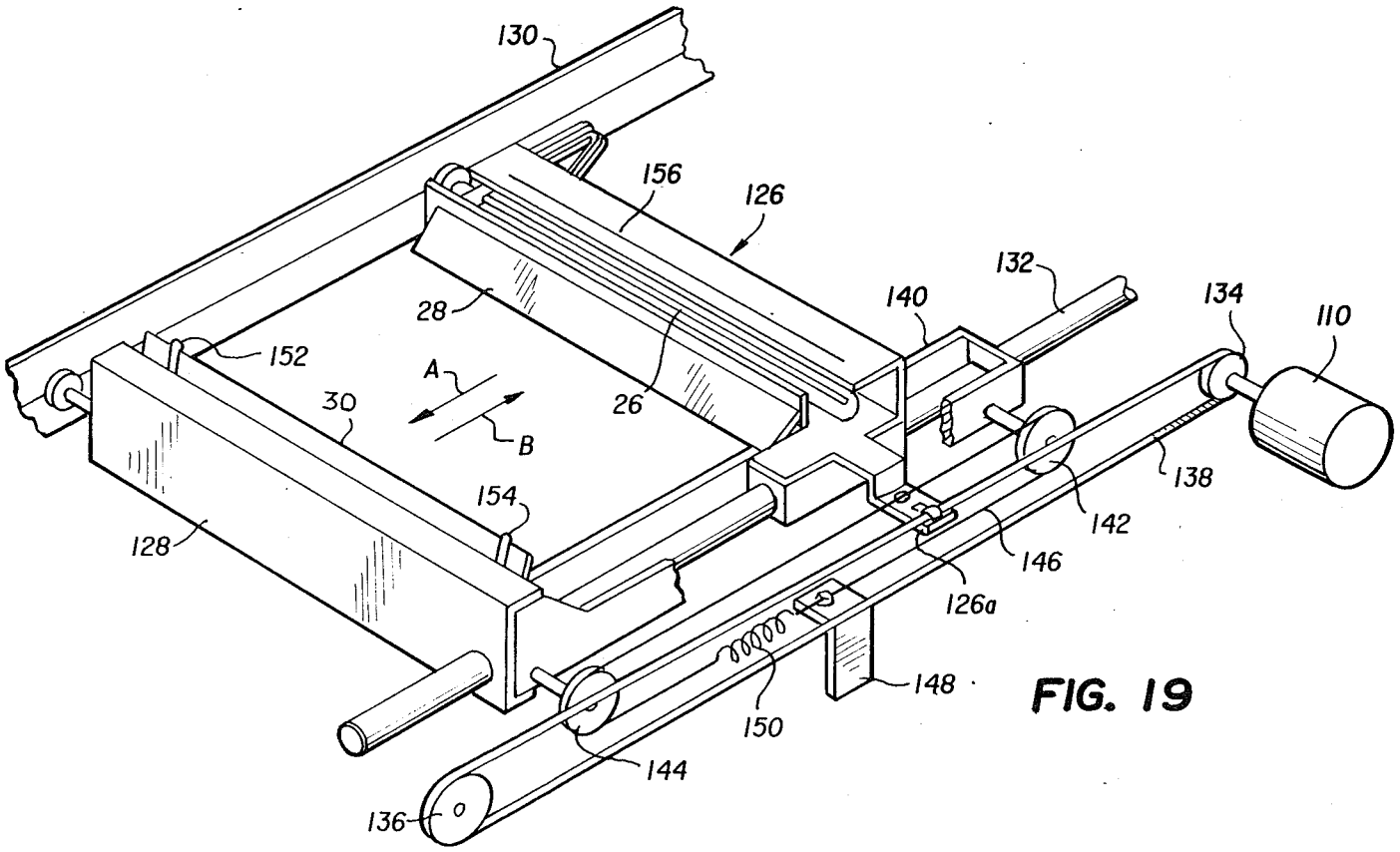
FIG. 19 is a perspective view showing in outline the drive mechanism of the optical system used for the image forming apparatus.

FIG. 19 is a perspective view showing the scanning mechanism for moving optical system 24 consisting of exposure lamp 26 and mirrors 28, 30 and 32 along document table 20. Exposure lamp 26 and mirror 28 are fixed to a first carriage 126 and mirrors 30 and 32 to a second carriage 128. These carriages 126 and 128 can move, guided by guide-rails 130 and 132 in the direction of the arrows A and B. Scanning motor 110 which is a 4-phase pulse motor, drives a pulley 134. An endless belt 138 is wound around this pulley 134 and an idle pulley 136. One end 126*a* of first carriage 126, on to which exposure lamp 26 and mirror 28 are fixed, is secured to this belt 138. A guide 140 forms an intergral part of second carriage 128, on to which mirrors 30 and 32 are fixed. This guide 140 straddles guide rail 132 and can move back and forth along it. Two pulleys 142 and 144 are mounted on this guide part 140 with a space between them in such a way that they can rotate in the axial direction of rail 132. A wire 146 is wound around these pulleys 142 and 144, one end of this wire 146 being secured to a fixing piece 148, and the other to fixing piece 148 via a coil spring 150. As scanning motor 110 rotates, belt 138 revolves and first carriage 126 is moved, and with it second carriage 128 also. When this happens, since pulleys 142 and 144 perform the function of a fall block, second carriage 128 moves at half the speed of first carriage 126, in the same direction. The direction in which first and second carriages 126 and 128 move in controlled by switching the direction of rotation of scanning motor 110.

The area which can be copied, corresponding to the paper size that has been designated, is displayed on document table 20. If the size of the paper selected by the cassette selection key 90 is taken as (Px, Py), and the rate of enlargement/reduction designated by rate setting key 98 of ZOOM key 100 as K, then the area can be copied (X, Y) is as follows.

$$X = Px/K$$

$$Y = Py/K$$

In this area that can be copied (X, Y), the X direction is indicated by pointers 152 and 154, while the Y direction is indicated by a scale 156 on the top of first carriage 126.

Figure 20:
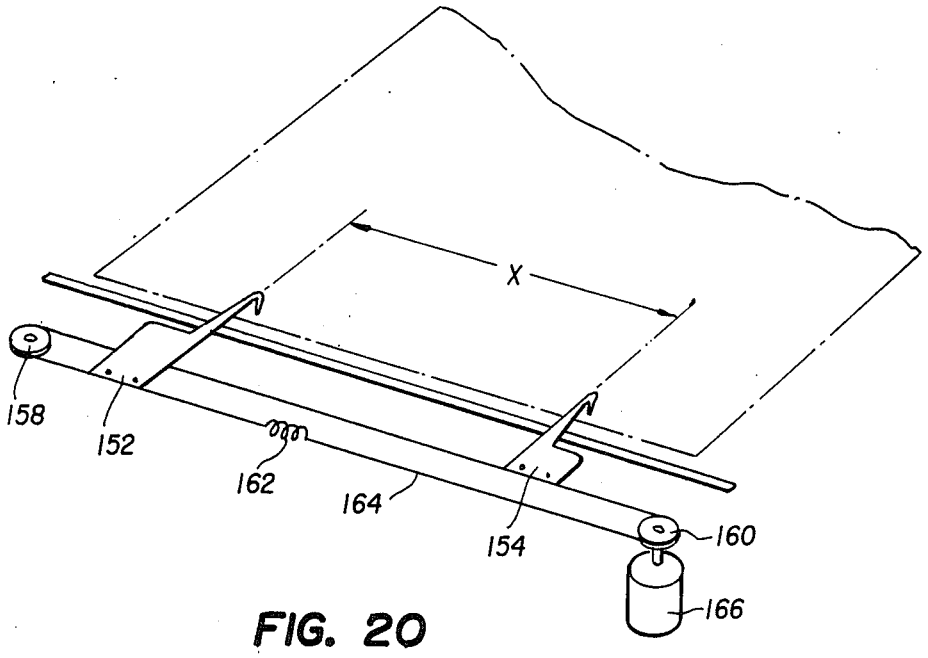
FIG. 20 is a perspective view showing in outline the drive mechanism of the pointers used for the image forming apparatus.

As shown in FIG. 20, pointers 152 and 154 are fixed to a wire 164 wound around pulleys 158 and 160 via a coiled spring 162. A pulley 160 receives rotary drive from motor 166. The distance between the pointer 152 and pointer 154 is altered by the rotation of motor 166 in response to the selection of paper size and the enlargement/reduction rate.

Scanning motor 110 is driven, as a result of the selection of paper size and the enlargement/reduction rate, and first carriage 126 moves to a prescribed position, i.e., 'home' position, appropriate to the enlargement/reduction rate, and stops there. When COPY button 84 is pressed, first carriage 126 is first moved in the direction of the arrow A, and then, as it is in the extreme left position in FIG. 16, exposure lamp 26 comes on, whereupon first carriage 126 is moved in the direction of the arrow B. During this movement of first carriage 126 in the direction B, the document placed on document table 20 is irradiated by exposure lamp 26. When the scanning of the document is complete, exposure lamp 26 goes off, and first carriage 126 returns to its home position.

Figure 21:
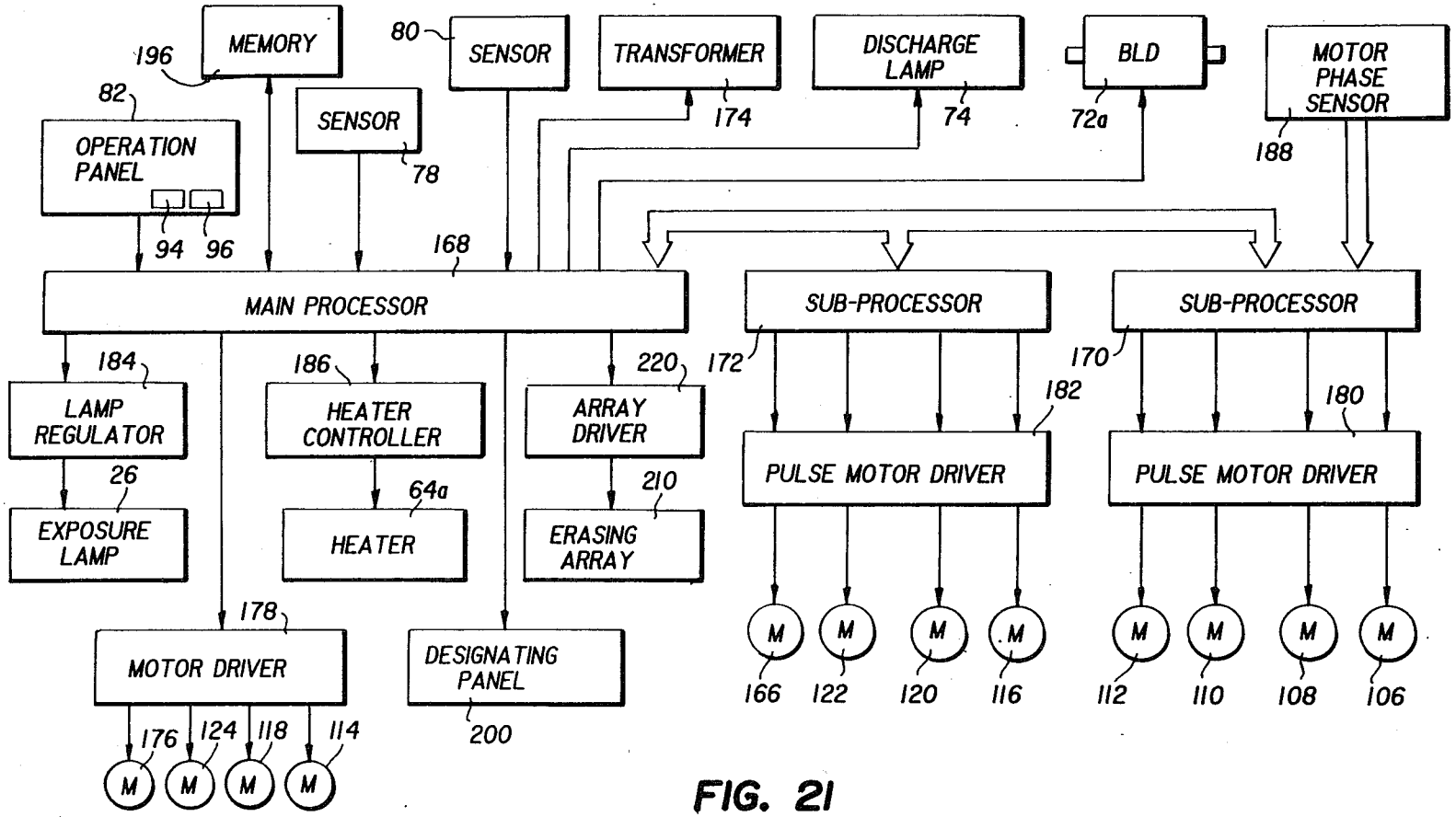
FIG. 21 is a control circuit diagram showing the electrical layout as a whole of this invention.

FIG. 21 shows the entire control circuit. The principal components of this circuit are a main processor 168 and first and second sub-processors 170 and 172. Main processor 168 executes the copying operation described above by detecting the inputs from operation panel 82 and cassette size sensors 78 and 80, and by controlling a high voltage transformer 174 (which energizes the various charger), discharge lamp 74, a blade solenoid 72*a* of cleaner 72, a heater 64*a* of pair of fixing rollers 64, exposure lamp 26 and motors 106–122, 166 and 176. Main processor 168 also executes the operation for erasure of the unwanted parts of the document image original, by controlling image area designating panel 200, an erasing array 210, an array driver 220 and a memory 196 (to be described later).

Of motors mentioned above 114, 118, 124 and toner motor 176 (for feeding toner to developing unit 42) are controlled by main processor 268 via a motor driver 178. Motors 106, 108, 110 and 112 are controlled by first sub-processor 170 via a pulse motor driver 180. Motors 116, 120, 122 and 166 are controlled by second sub-processor 172 via a pulse motor driver 182. Exposure lamp 26 is controlled by main processor 168 via a lamp regulator 184. Heater 64*a* is controlled by main processor 168 via a heater controller 186. 'Run' or 'stop' instructions for the various motors are sent from main processor 168 to first and second subprocessors 170 and 172. A status signal indicating a 'run' state or a 'stop' state is sent from sub-processors 170 and 172 to main processors 168. Position information from motor phase sensor 188, which detects each initial position of motors 106–112, is input into first sub-processor 170.

Figure 1:
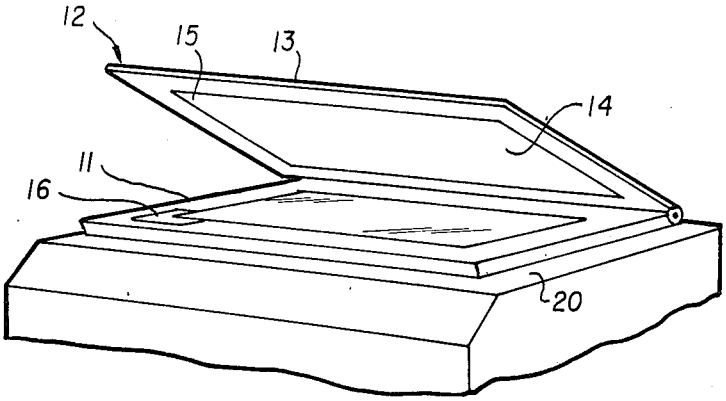
FIG. 1 is a perspective view of the document table part of the image forming apparatus of a first embodiment according to this invention.
Figure 2:
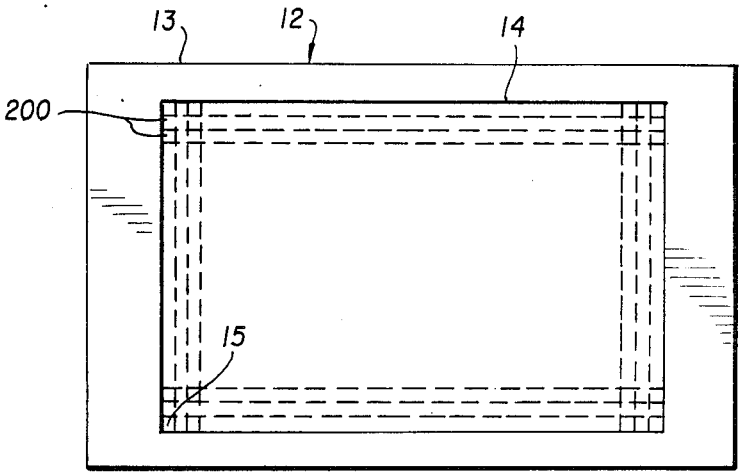
FIG. 2 is a plan view of the support body provided on the document table of FIG. 1.

An explanation will now be given of a first embodiment of the essential feature of the present invention. In FIG. 1, a support body 12, which can hinge independently of document cover 11, is provided above document cover 11. This support body 12, which is flat and has the same area as document cover 11, consists, as shown in FIG. 2, of a rectangular frame 13 and a plate of transparent glass 14 fitted within this frame 13. It is positioned so that when it is hinged down over document cover 11, one corner 15 of transparent glass 14 coincides with the locating part 16, provided on the upper surface of document cover 11, for determining the position in which the document is to be placed.

Figure 3:
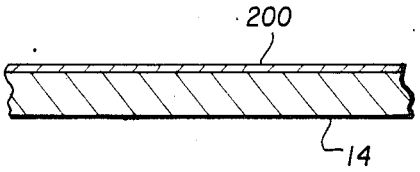
FIG. 3 is a sectional side view of the main part of the support body shown in FIG. 2.
Figure 4:
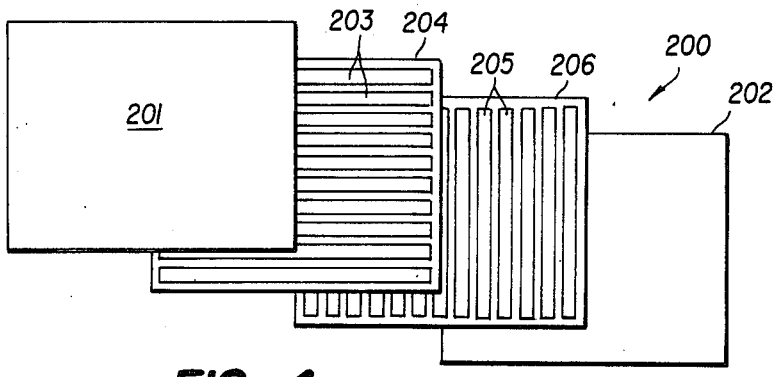
FIG. 4 is a exploded view of the image area designating panel according to this invention.

As shown in FIG. 3, an image area designating panel 200 for designating the area of which an image is to be formed is provided on the upper surface of transparent glass 14. As shown in FIG. 4, this designating panel 200 comprises a pair of flat transparent films 201 and 202 having the same area with transparent glass 14, a flexible electrode sheet 204 provided between these films, which carries a group of strips of transparent conductive film 203 arrayed in the line direction, and a fixed electrode sheet 206 provided between this flexible electrode sheet 204 and transparent film 202 which carries a group of strips of transparent conductive film 205 arrayed in the row direction. Flexible electrode sheet 204 and fixed electrode sheet 206 are separated by a small clearance gap so that the groups of transparent conductive film strips 203 and 205 do not, in the 'normal' state, make electrical contact with each other. Electrode sheets 204 and 206 are positioned between transparent films 201 and 202 to which they are bonded so as to form an integral whole in each case. Thus the groups of transparent conductive film strips 203 and 205, which face each other with a gap between them, form a plurality of pressure switches arranged in the form of a matrix as shown schematically in FIG. 5. What happens is when pressure is applied to transparent film 201, then, of the group of transparent conductive film strips 203 on flexible electrode sheet 204, that which corresponds to the position at which pressure was applied makes contact with that one of the group of transparent conductive film strisp 205 on fixed electrode sheet 206 which also corresponds to this position, and a signal is achieved denoting the position at which pressure was applied.

Figure 5:
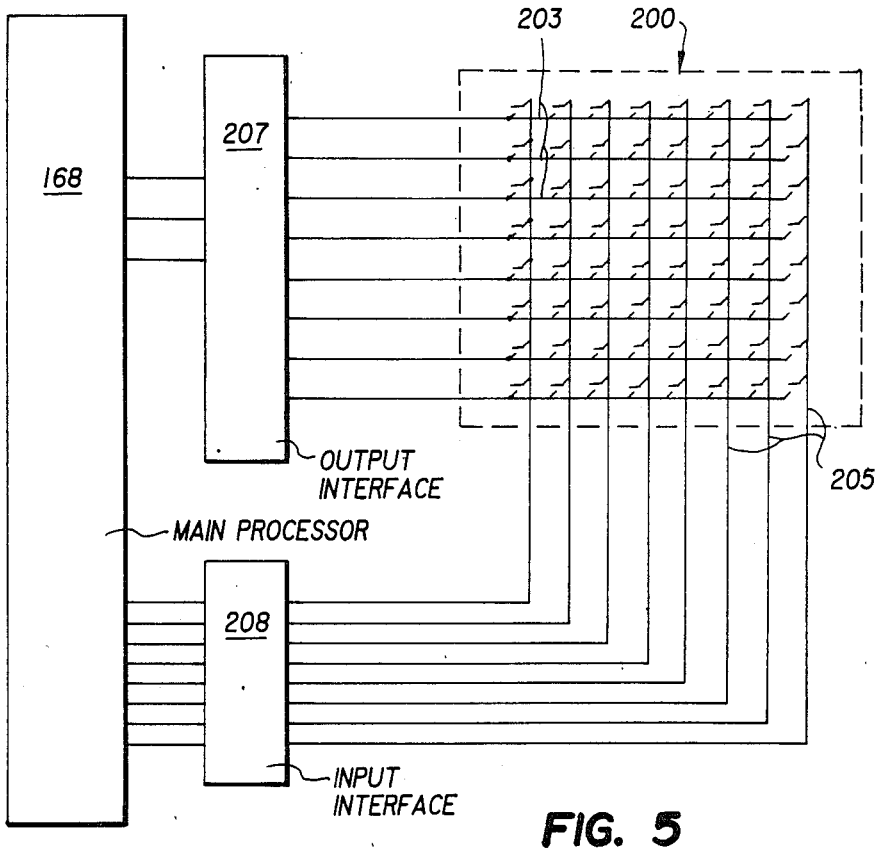
FIG. 5 is a electrical wiring diagram of the image area designating panel of FIG. 4.

As shown in FIG. 5, the group of transparent conductive film strips 203 of image area designating panel 200 is connected electrically via an output interface 207 to main processor 168, while the group of transparent conductive film strips 205 is connected electrically via an input interface 208 to main processor 168. The signals outputted cyclically from main processor 168 via output interface 207 are fed sequentially to the group of film strips 203 of panel 200; when a point of intersection corresponding to the position at which pressure was applied causes one of the group of film strips 203 to make contact whith one of the group of film strips 205, a 'pressed' signal is output from that point, and this output signal is input via input interface 208 into main processor 168. The output signal from panel 200 which has been input into main processor 168 is supplied via main processor 168 to memory 196, shown in FIG. 21. This memory 196 consists of a RAM having a storage capacity matching the number of intersection points of the groups of film strips 203 and 205.

Figure 6A:
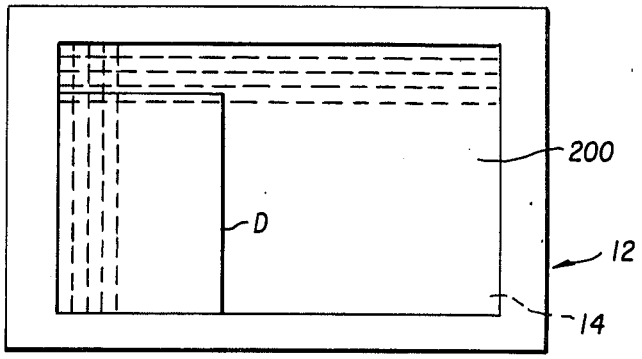
FIGS. 6A, 6B, 7A and 7B are plan views provided to explain the operation of the designation of areas for image erasure by using the image area designation panel of FIG. 4.

Next, an explanation will be given of how the area of the document to be copied is designated. Support body 12 is opened, as shown in FIG. 1, one corner of the document D is aligned with a guide part 16 of document cover 11, so that the side of the document with the image to be copied faces support body 12, i.e., upwards. When in this state support body 12 is closed, the document D can be seen through transparent glass 14 and image area designating panel 200 (FIG. 6A). In FIG. 6A, the groups of transparent conductive film strips 203 and 205 of image area designating panel 200 are shown by dotted lines, but in fact they are virtually transparent and are therefore not visible.

Figure 6B:
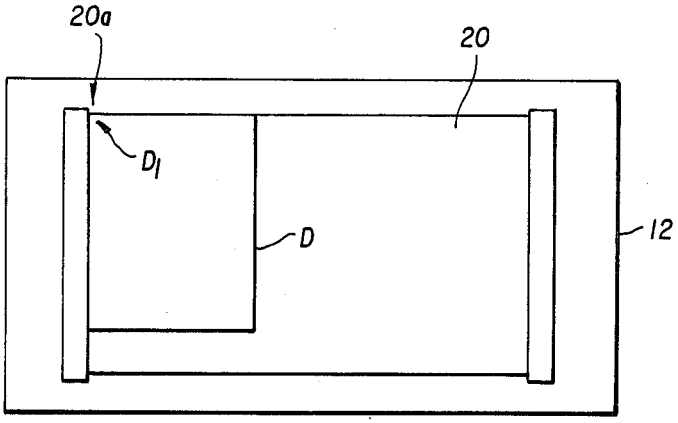
Figure 7A:
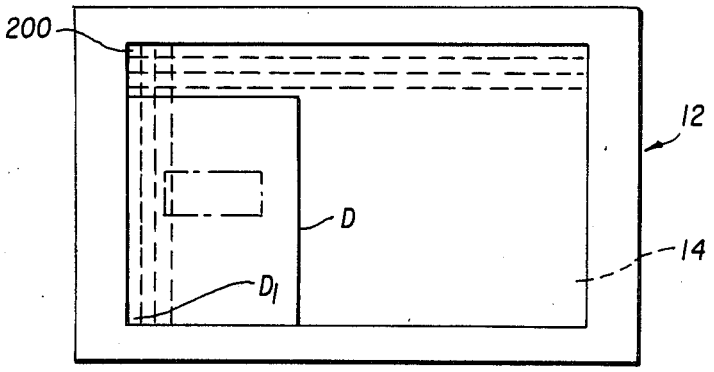
Figure 7B:
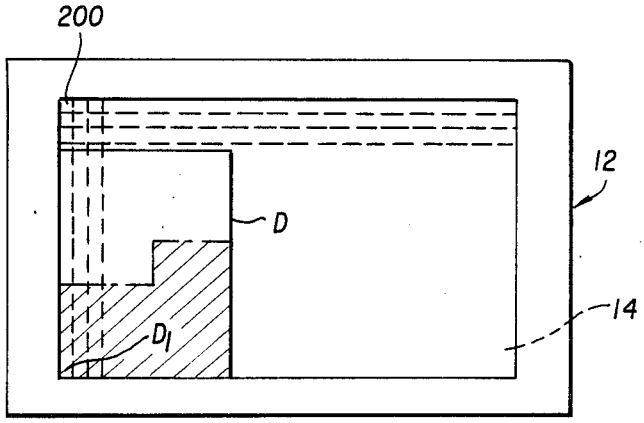
Figure 8A:
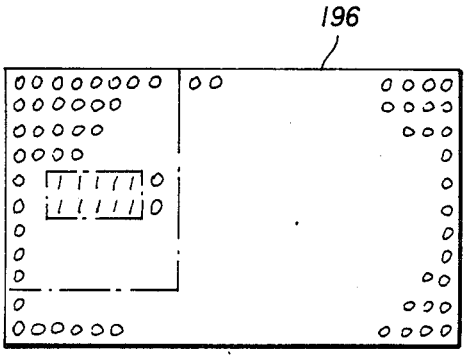
FIGS. 8A and 8B are schematic views showing the mapping of the data stored in the memory according to this invention.

When, in this state, the four points on image area designating panel 200 defining the area to be erased of the document which is indicated by the oblique lines in FIG. 7A are pressed, and 'erase inside selected area' button 94 on operation panel 82 is also pressed, a high level signal '1' is written via main processor 168 into the addresses corresponding to the area to be erased of memory 196, while a low level signal '0' is written into the other addresses as shown in FIG. 8A. In this embodiment, these signals are written into memory 196 mapped on to the mirror image of support body 12. What happens is that since, when the document D is actually to be copied, the corner $D_1$ of the document D is aligned with a corner 20*a* of document table 20, and the side to be copied of the document D faces document table 20 (FIG. 6B), the signals for memory 196 are written in a corresponding manner. Again, when the six points on image area designating panel 200 defining the area to be erased of the document D which is shown by the oblique lines in FIG. 7B are pressed, and the 'erase inside selected area' button 94 on operation panel 82 is also pressed, a high level signal '1' is written via main processor 168 into the addresses corresponding to the area to be erased of memory 196, while a low level signal '0' is written into the other addresses as shown in FIG. 8B.

Figure 9:
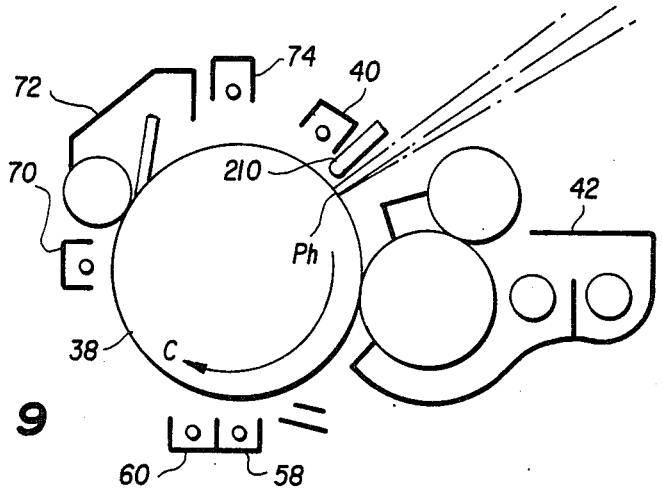
FIG. 9 is a schematic side view showing the disposition of the erasing array according to this invention.
Figure 10:
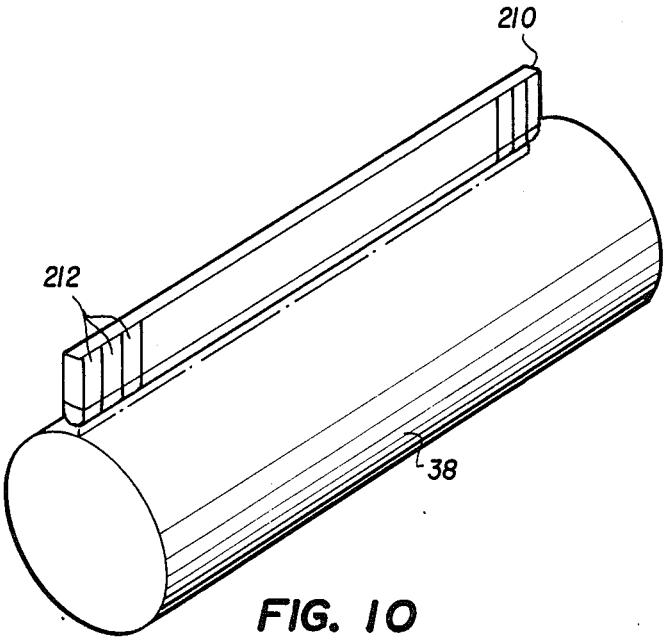
FIG. 10 is a perspective view showing the positional relationship of the erasing array and the photosensitive drum of FIG. 9.
Figure 11:
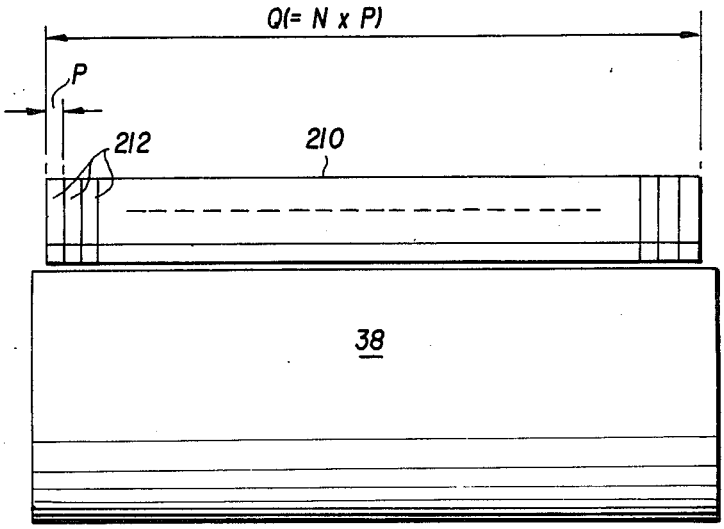
FIG. 11 is a front view of the positional relationship of the erasing array and the photosensitive drum of FIG. 10.
Figure 12A:
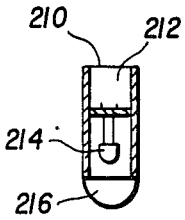
FIG. 12A is a sectional side view of the erasisng array of FIG. 11.
Figure 12B:
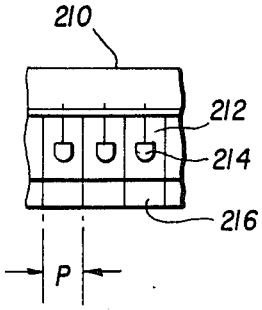
FIG. 12B is a front view showing a part of the erasing array in section.

An erasing array 210 is provided as the image formation prevent means, between and in close proximity to main charger 40 of photosensitive drum 38 and an exposure zone Ph (FIG. 9). This erasing array 210 has a plurality of cylindrical cells 212 arranged in a row at right angles to the direction of rotation of photosensitive drum 38 (FIGS. 10 and 11). A light-emitting element 214 consisting of a light-emitting diode provided within each of these cells 212 (FIGS. 12A and 12B). A lens 216 which condenses the light of light-emitting element 214 on to the surface of photosensitive drum 38 is provided at the opening of each cell 212 facing photosensitive drum 38. The number of light-emitting elements provided in this erasing array 210 is identical with the number of film strips in the group of transparent conductive film strips 203 in the transverse direction of image area designating panel 200. If the width of a cell 212 is taken as P and the number of cells 212 as N, the overall length of erasing array 210 is given by $Q=N\times P$.

Figure 13:
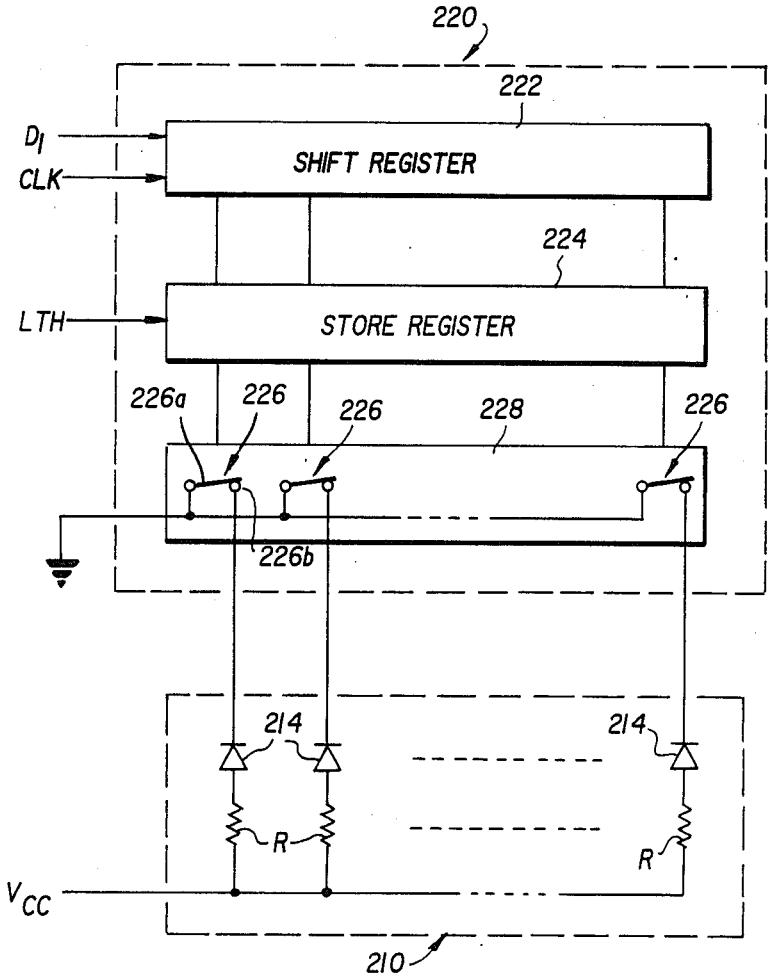
FIG. 13 is a circuit diagram showing the layout of the drive part of the erasing array.

Erasing array 210 is driven by the previously-mentioned array driver 220. As shown in FIG. 13, this array driver 220 is made up of a shift register 222 having the same number of bits as the bits in the line direction of memory 196, a store register 224 in which the contents of this shift register 222 are held and a switch circuit 228 consisting of a plurality of switch element 226 which are switched on or off by the output signals from this store register 224. A moving contact 226*a* of each switch element 226 is earthed and a fixed contact point 226*b* is connected to the cathode of one of light-emitting elements (light-emitting diodes) 214 constituting erasing array 210. The anodes of light-emitting elements 214 are connected, in each case via a current-limiting resistance R to a power source Vcc.

Figure 8B:
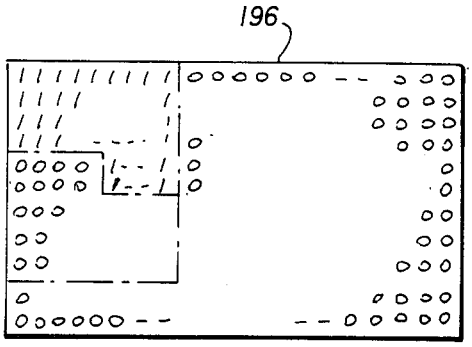

When after the area to be erased of the document has been designated in the manner described, the document D is withdrawn from support body 12 and placed on document table 20 as shown in FIG. 6B and COPY button 84 is pressed, first carriage 126 and photosensitive drum 38 move, while at the same time the data relevant to the first row is read sequentially from memory 196 in the row direction (FIGS. 8A and 8B). This data D1 is transferred, as it is read, by a clock signal CLK to shift register 222 of array driver 220. After the data for the first row has been transferred to shift register 222, when the charged part of photosensitive drum 38 reaches erasing array 210, a latch signal LTH is output from main processor 168 and in response to this signal the contents of shift register 222 are loaded into store register 224. Since erasing array 210 is disposed between main charger 40 and exposure zone Ph, the timing of the output of the latch signal LTH is controlled so that, if the angle between erasing array 210 and exposure zone Ph is taken as $\theta_1$, and photosensitive drum 38 rotates at an angular velocity of $\omega$, the data for the first row output from memory 196 is supplied to store register 224 before $\theta_1/\omega$.

Switch elements 226 of switch circuit 228 are controlled by output signals of store register 224. When the output signals of store register 224 are high level, switch elements come ON, while when the signals are low level, they go OFF. As a result, the light-emitting elemtents 214 connected to switch elements 226 are ON when switch elements 226 are ON, and OFF when the latter are OFF. Consequently, of the charged parts of photosenstive drum 38, those parts opposite where light-emitting 214 have been switched on are discharged, and thereafter no electrostatic latent image is formed on these parts even when they are exposed, so that erasure of the document image original in respect of those parts has been effected. Thereafter, data from memory 196 is read one row at a time and image erasure continued in the same manner.

Figure 14:
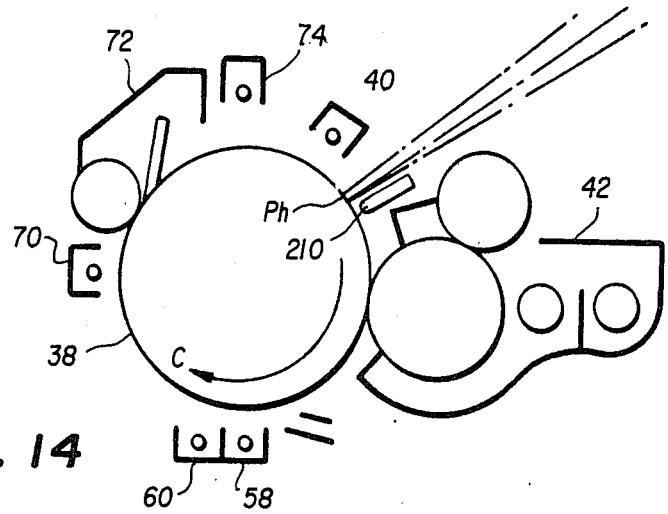
FIG. 14 is a schematic side view showing the another disposition of the erasing array according to this invention.

It is also possible as shown in FIG. 14, to have erasing array 210 disposed between exposure zone Ph and developing unit 42, so that an area of the electrostatic latent image corresponding to that designated by panel 200 is erased it has been formed.

It is also possible to have an arrangement (not shown in Figure) such that the formation of an electrostatic latent image of the part not required is prevented simultaneously with exposure, by irradiating exposure zone Ph with light from erasing array 210.

Figure 22:
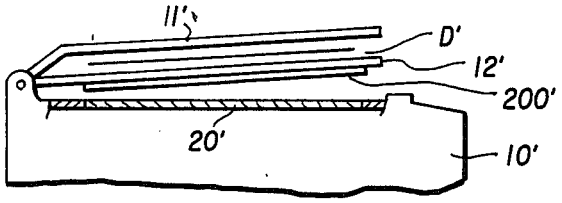
FIG. 22 is a schematic side view of a document table, illustrating a second embodiment of this invention.
Figure 23:
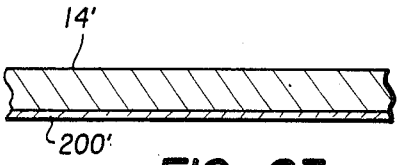
FIG. 23 is a sectional side view of the main part of the support body in FIG. 22.

FIG. 22 shows a second embodiment in which the position of image area designating panel of the invention has been changed. In FIG. 1, which depicted the first embodiment, support body 12 on which image designating panel 200 was provided was placed, in such a way that is could hinge freely above document cover 11. In this second embodiment, in contrast, a support body 12' is placed, in such a way that it can hinge freely between a document table 20' and a document cover 11' and independently of document cover 11'. Again, in the first embodiment as shown in FIG. 2, image area designating panel 200 was provided on the upper surface of the plate of transparent glass 14, whereas in the second embodiment as shown in FIG. 23, an image area designating panel 200' is provided on the under surface of a plate of transparent glass 14'. This transparent glass 14' is positioned so that when support body 12' is hinged down over document table 20', the four corners of document table 20' coincide with the four corners of transparent glass 14'.

Figure 24:
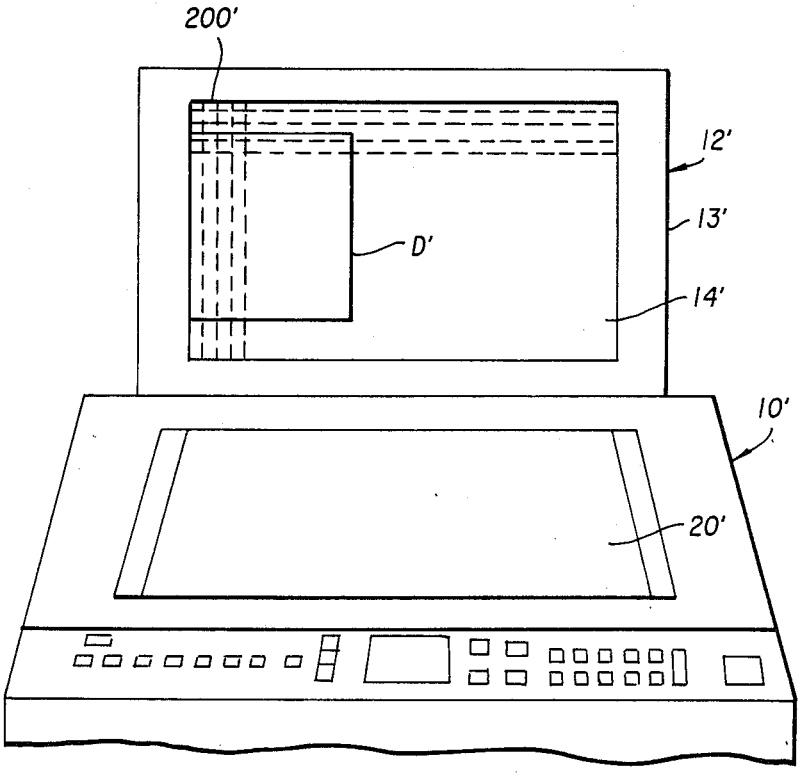
FIG. 24 is a perspective view of the document table of FIG. 22.

Consequently, when the area to be copied of the document D' is to be designated, the document D' is placed between support body 12' and document cover 11' so that it faces transparent glass 14', i.e., downwards (FIG. 22). When in this state document cover 11' is closed, and support body 12' is then opened with document cover 11', then, as shown in FIG. 24, the document D' can be seen through transparent glass 14' and image area designating panel 200'. In FIG. 24, the groups of the transparent conductive film strips of designating panel 200' are shown by dotted lines, but in fact they are virtually transparent and are therefore not visible. When, with support body 12' and document cover 11' thus in the open state, in the same way as in the first embodiment (FIGS. 7A and 7B) a high level signal '1' is written into the addresses in memory 196 corresponding to the area to be erased, and a low level signal '0' into the other addresses.

As already explained, after the area to be copied or erased of the document has been designated and this area for erasure written into memory 196, document cover 11' and support body 12' are closed, COPY button 84 is pressed and the document D' is exposed by irradiation from exposure lamp 26 (FIG. 16) through document table 20', image area designating panel 200' and support body 12' (FIG. 22), and an image is produced on photosenstive drum 38.

The working of the erasure of the latent image is the same as that described in connection with the first embodiment, and the explanation is therefore not repeated here.

Figure 25:
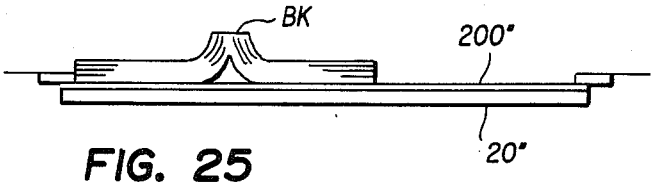
FIG. 25 is a front view showing the state when a book-shaped document is placed on the document table in a third embodiment of this invention.
Figure 26:
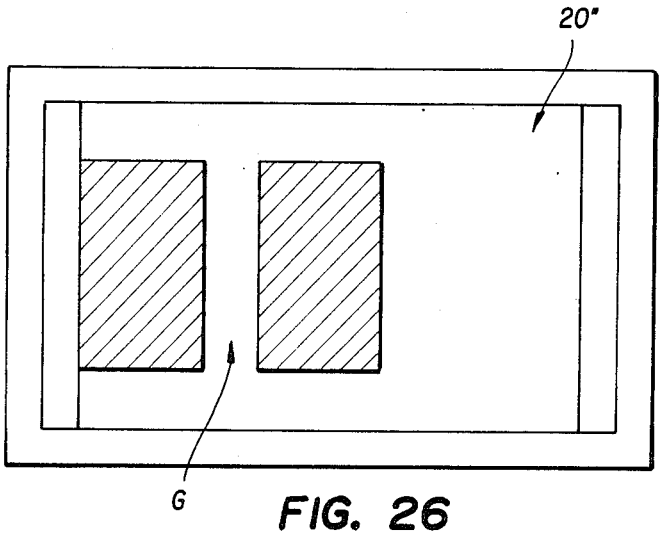
FIG. 26 is a plan view of the document table, showing the area of the document which is copied when a book-shaped document is placed on the document table as in FIG. 25.
Figure 27:
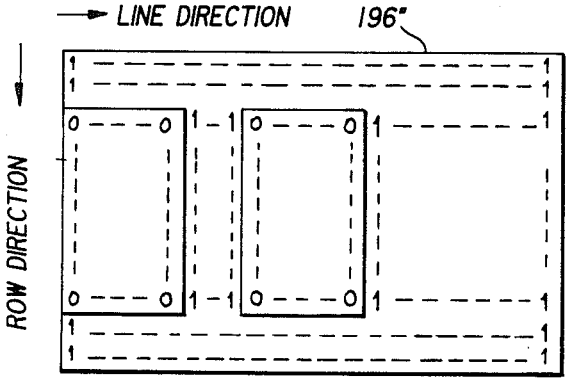
FIG. 27 is a schematic view showing the mapping of the data stored in the memory corresponding to the areas being copied in FIG. 26.

FIG. 25 shows a third embodiment in which the position of the image area designating panel of the invention has been changed again. In this third embodiment, only that area of a document which is in direct contact with the surface of the table on which the document is placed constitutes the area of which an image is formed, the image of any other part being erased. An image area designating panel 200'' is provided directly on the upper surface of a document table 20'' of transparent glass on which the document is placed. The construction of this panel 200'' is the same as that described in the case of the first embodiment (FIG. 4). When, as shown in FIG. 25, a comparatively thick opened book Bk is placed on document table 20'', the weight of the book Bk ensures that as shown in FIG. 26, that part of panel 200'' corresponding to the two adjoing pages (indicated by the oblique lines in the drawing) is pressed down so that as shown in FIG. 27, a low level '0' signal indicating the area of which an image is to be formed, is sent to the addresses in a memory 196'' corresponding to the parts to which pressure has been applied. The gutter part G between the pages and the area around the book Bk, do not press down on panel 200'', and a high level '1' signal indicating areas for image erasure, is therefore remembered at addresses in memory 196'' corresponding to those parts.

The operation by which the image is formed is the same as that described in connection with the first embodiment, and the explanation is therefore not repeated here.

What is claimed is:

1. An image forming apparatus, wherein an electrostatic latent image is formed on a photosensitive body by a process of electrical charge and image exposure and a reproduced image is formed by the development of the electrostatic latent image, comprising:

(a) a main body;

(b) a transparent glass provided at the top of said main body for holding a document;

(c) image area designating means mounted directly on the upper surface on said transparent glass for designating a required copy area of the document, which includes, (i) first transparent electrode sheet means having a plurality of conductive members arrayed on it in rows in one direction, and (ii) second transparent electrode sheet means provided opposite said first electrode sheet and having a plurality of conductive members arrayed on it in rows at right angles to the conductive members of said first transparent electrode sheet, wherein said image area designating means generates electrical signals from electrical contact points corresponding to the required copy area designated by pressing said first transparent electrode sheet so that the conductive members of first and second transparent electrode sheets electrically contact each other;

(d) memory means for storing the electrical signals generating by said image area designating means; and (e) image formation preventing means for preventing the formation of an electrostatic latent image on said photosensitive body other than in the area to be copied, according to the electrial signals read from said memory means.

2. The image forming apparatus according to claim 1, wherein said photosensitive body is drum-shaped and said image forming preventing means comprises a plurality of light-emitting elements arrayed in a row facing said drum-shaped photosensitive body and at right angles to the direction in which it rotates.

3. The image forming apparatus according to claim 2, wherein the light-emitting elements of said image formation preventing means are arranged at positions so as to radiate the photosensitive body in the image exposure step.

4. The image forming apparatus according to claim 2, wherein the light-emitting elements of said image formation preventing means are arranged at positions so as to radiate the photosensitive body in the image development step.

5. The image forming apparatus according to claim 2, wherein said image formation preventing means includes a drive means for driving said image formation preventing means.

6. The image forming apparatus according to claim 5, wherein said drive means includes a shift register, a store register into which the contents of said shift register are loaded and a switch circuit comprises a plurality of switch elements controlled by output of said store register and electrically connected in a one-to-one corresponding to the light-emitting elements of said image formation preventing means.

7. An image forming apparatus, wherein an electrostatic latent image is formed on a photosensitive body by a process of electrical charge and image exposure and a reproduced image is formed by the development of the electrostatic latent image, comprising:

(a) document holding means for holding a document;
(b) image area designating means coupled to said document holding means for designating a required copy area of the document to generate electrical signals corresponding to the required copy area;
(c) memory means for storing the electrical signals generated by said image area designating means;
(d) a plurality of light-emitting elements arrayed in a row facing said photosensitive body; and
(e) a drive means for driving said plurality of light-emitting elements to selectively actuate each of said light-emitting elements in response to data from said memory means.

8. The image forming apparatus according to claim 7, wherein:

said drive means includes shift register means for receiving data from said memory means, store register means for storing the contents of said shift register, and a switch circuit comprising a plurality of switch elements controlled by an output from said store register and electrically connected in one-to-one correspondence to said light-emitting elements.

* * * * *